United States Patent [19]

Fujii

[11] Patent Number: 5,057,825

[45] Date of Patent: Oct. 15, 1991

[54] WINDOW DISPLAY CONTROL DEVICE

[75] Inventor: Naoki Fujii, Hachiouji, Japan

[73] Assignee: Kabushiki Kaisha Toshiba, Kawasaki, Japan

[21] Appl. No.: 413,534

[22] Filed: Sep. 28, 1989

[30] Foreign Application Priority Data

Sep. 29, 1988 [JP] Japan ..... 63-242510

[51] Int. Cl.[5] ..... G09G 1/06

[52] U.S. Cl. ..... 340/721; 340/723; 364/521

[58] Field of Search ..... 340/721, 723, 734; 364/521

[56] References Cited

U.S. PATENT DOCUMENTS 4,618,858 10/1986 Belch ..... 340/721

4,700,320 10/1987 Kapur ..... 340/723

4,710,767 12/1987 Sciacero et al. ..... 340/721

FOREIGN PATENT DOCUMENTS 8605910 10/1986 World Int. Prop. O. ..... 340/721

*Primary Examiner*—Ulysses Weldon

*Assistant Examiner*—M. Fatahiyar

*Attorney, Agent, or Firm*—Foley & Lardner

[57] ABSTRACT

There is disclosed a window display control device for display of a window image on a CRT image plane or the like. This device enables high speed data display in a virtual window region on renewal of the image plane thereof, and also enables preferential data display in the virtual window region without waiting for renewal of the entire body of an output data text thereof.

1 Claim, 3 Drawing Sheets

WINDOW DISPLAY CONTROL DEVICE

BACKGROUND OF THE INVENTION

1. Field of the Invention

The present invention relates to a window display control device which is used for displaying window picture images on a CRT image plane or the like, and particularly to a window display control device which enables high speed data display in a virtual window region on renewal of the image plane.

2. Description of the Prior Art

FIG. 1 is a block diagram to schematically show construction of a conventional window display control device.

As shown in the same diagram, a window display control device 1 comprises a buffer memory 2, data process means 3, an virtual image plane memory 4, window control means 5 and a view port memory 6.

In the buffer memory 2, an output data from a data process device is contained. The data process means 3 converts the output data contained in the buffer memory 2 into display data.

In the virtual image plane memory 4, the display data converted by the data process means 3 are contained. The window control means 5 retrieves only display data in a virtual window region 4*a* separately designated in the virtual image plane memory 4 in accordance with a predetermined display start command.

In the view port memory 6, the display data retrieved by the window control means 5 are contained. The data contained in the view port memory 6 are displayed in a CRT image plane 7.

As described above, only the display data contained in the virtual window region 4*a* of those contained in the virtual image plane memory 4 are displayed in the CRT image plane 7, and when the virtual window region 4*a* is suitably moved, a window image displayed on the CRT image plane also moves.

However, in such a conventional window display control device, when the display data in the virtual image plane memory 4 are renewed, the window control means 5 is arranged so as not to retrieve data in the virtual window region 4*a* until all of the renewal of the renewal data supplied from the data process means 3 is completed. Accordingly, as shown in FIG. 2, when an amount of output data 8 localized in the virtual window region 4*a* is small as compared with a size of the entire body of an output data 9, since the output data 8 are actually displayed on a screen after a renewal process of all the data is completed, the display speed of the data 8 becomes very low even though the amount thereof is small.

This problem becomes remarkable as the amount of the output data localized in the virtual window region 4*a* is small as compared with the size of the entire body of the output data 9.

SUMMARY OF THE INVENTION

An object of the present invention is to provide a window display control device which enables high speed data display in a window region on renewal of an image plane.

Another object of the virtual present invention is to provide a window display control device which can preferentially display only display data in the window region without waiting renewal of the entire body of an output data.

In order to achieve the above objects, a feature of the present invention resides in a window display control device comprising a buffer memory for containing an output data from a data process device, data process means for converting the output data text contained in the buffer memory into display data, a virtual image plane memory for containing the display data converted in the data process means, window control means for retrieving only display data in a virtual window region separately designated in the virtual image plane in accordance with a predetermined display start command, a view port memory for containing the display data retrieved by the window control means and displaying the display data on a image plane, and window display acceleration means provided between the buffer memory and the data process means. The window display acceleration means is constructed to precedently feed an output data text localized in the virtual window region and commanded by the window control means into the data process means, and to give a display start command to the window control means immediately after completion of the feed of all the output data in the virtual window region and thereafter feeds an output data out of the virtual window region into the data process means.

According to the construction as described above, the window acceleration means preferentially feeds the output data localized in the virtual window region to the data process means, and gives a display start command to the window control means immediately after completion of the feed of all the output data located in the virtual window region, thus only the display data localized in the virtual window region can be preferentially fed to the view port memory without waiting for renewal of data outside the virtual window region in the virtual image plane memory. As a result, there can be realized high speed display of a window picture image on the renewal of the image plane.

These and other objects, features and advantages of the present invention will be more apparent from the following description of a preferred embodiment, taken in conjunction with the accompanying drawings.

DETAILED DESCRIPTION OF THE EMBODIMENT

Figure 3:
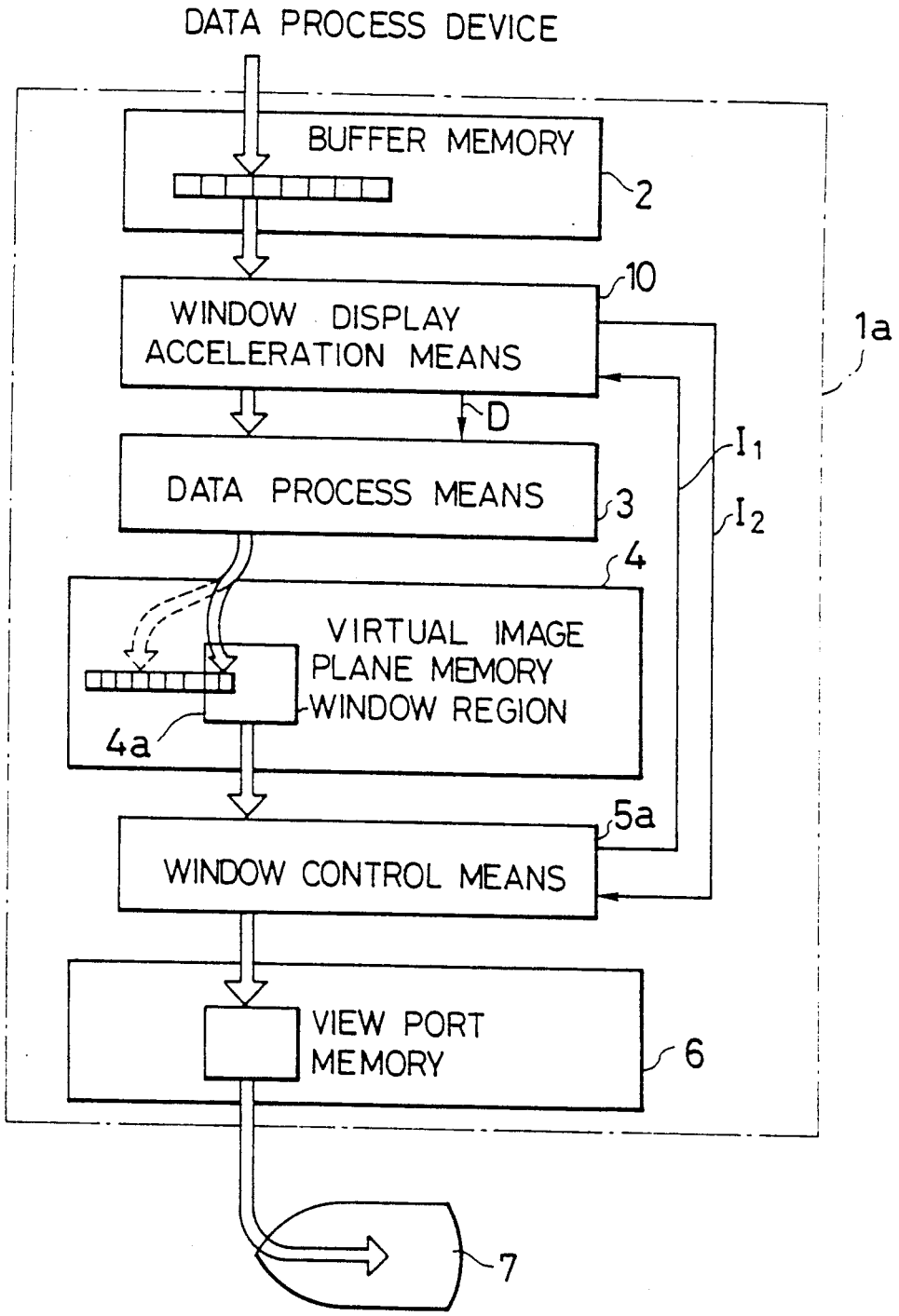
FIG. 3 is a block diagram of an embodiment of a window display control device according to the present invention.

FIG. 3 is a block diagram to schematically show an embodiment of a window display control device relating to the present invention.

Figure 1:
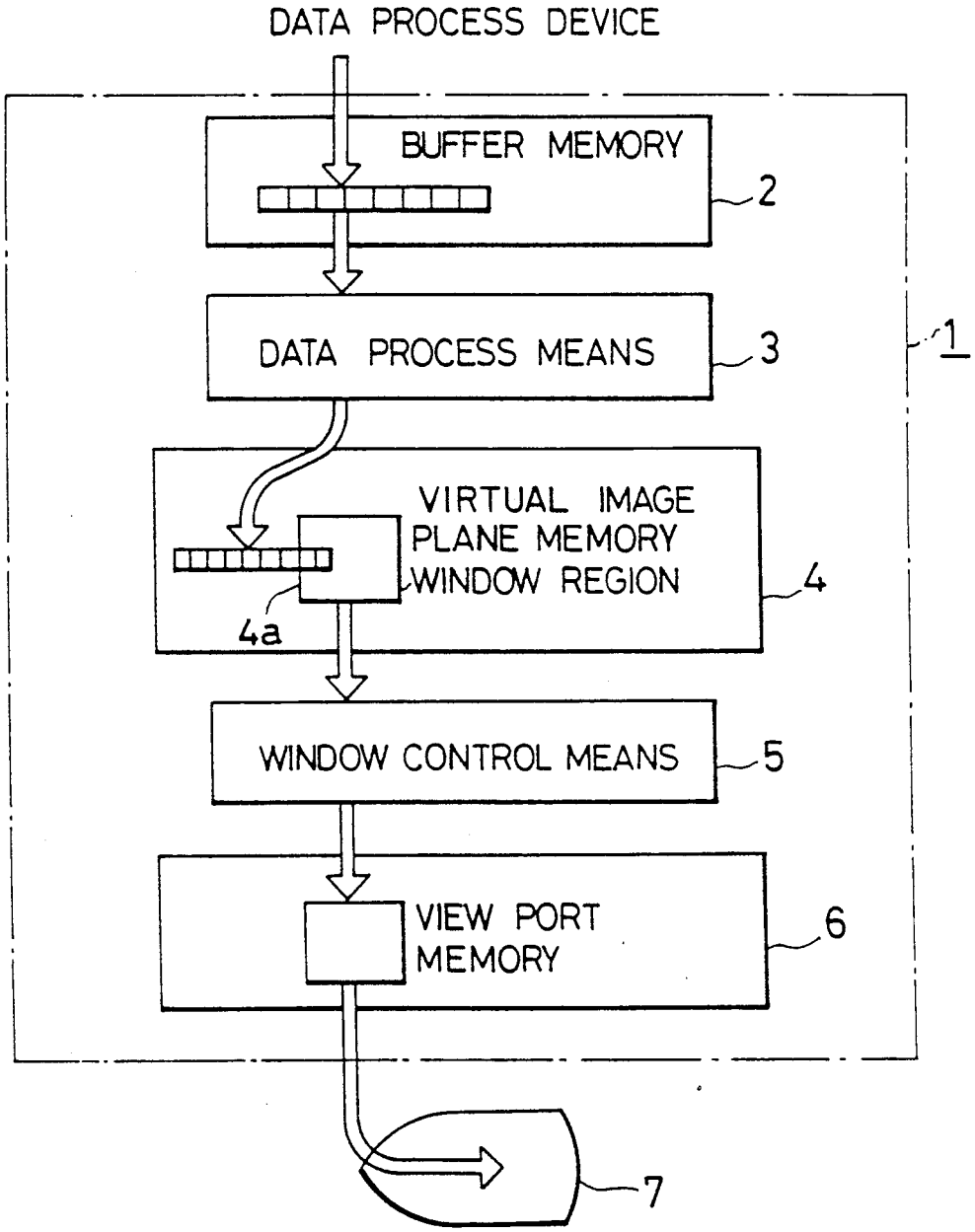
FIG. 1 PRIOR ART
FIG. 1 is a block diagram to show construction of a conventional window display control device.
Figure 2:
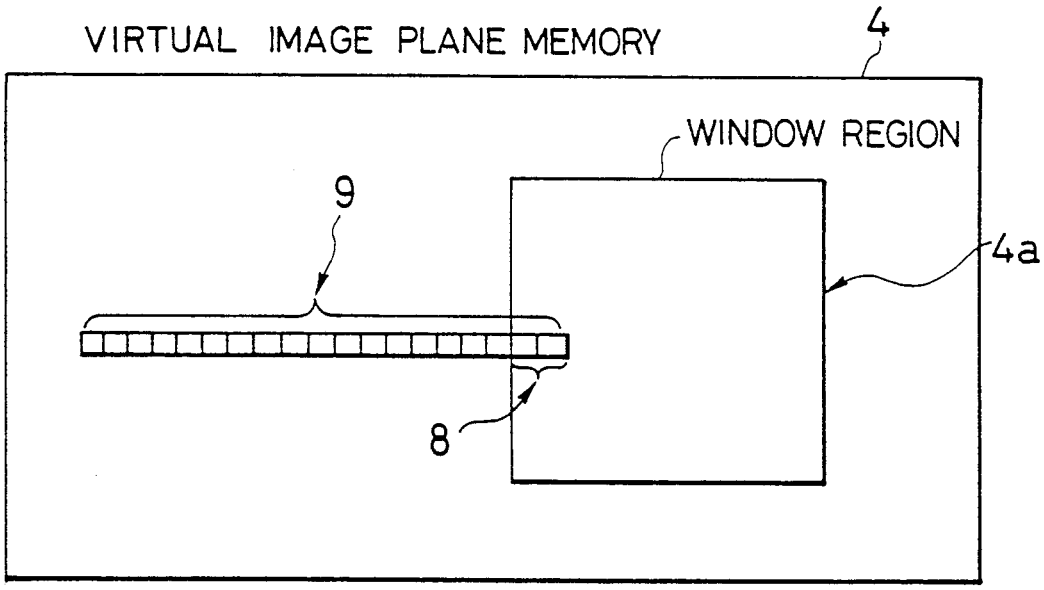
FIG. 2 is a schematical diagram to show an enlarged view of a virtual image plane memory shown in FIG. 1.

In the same diagram, reference numerals respectively designating compositional parts in the conventional example of FIG. 1 are used, thus explanations on them are not repeated.

As shown in FIG. 3, it is a feature of this window display control device 1*a* that window display acceleration means 10 is provided between a buffer memory 2 and data process means 3, that the window control means 5*a* has a novel construction.

Namely, the window control means 5*a* is arranged so as to provide the window display acceleration means 10 a positional information $I_1$ (x, y coordinate positions and lengths of x axis and y axis) to show what portion of a virtual image plane memory 4 is preferentially in a virtual window region 4*a*.

The window acceleration means 10 checks an output data text contained in the buffer memory 2, and retrieves output data to be located in the virtual window region 4*a* and commanded from the window control means 5*a* preferentially or selectively, then the window acceleration means 10 delivers the output data D in the virtual window region 4*a* to the data process means 3.

Subsequently, the data process means 3 converts the data D delivered from the window display acceleration means 10 into display data, then delivers them into the virtual image plane memory 4.

At the time, since the data D to be located in the virtual window region 4*a* are preferentially delivered, the data storing on the virtual window region 4*a* is carried out preferentially in the virtual image plane memory 4.

When the above delivery of the output data in the virtual window region 4*a* is completed, the window display means 10 immediately gives a display start command $I_2$ to the window control means 5*a*. Then, the window control means 5*a* retrieves the display data in the virtual window region 4*a* of the virtual image plane memory 4, and delivers the data into a view port memory 6. As the result, an image in the virtual window region 4*a* is immediately displayed on a CRT image plane 7 without waiting completion of renewal of all of the virtual image plane memory 4, thus an apparent display renewal speed is improved.

Thereafter, the window display acceleration means 10 delivers output data text outside of the window region 4*a* to the data process means 3 in the same manner as conventional ones.

Accordingly, in the virtual image plane memory 4, storing of display data outside of the window region 4*a* is carried out later after the storing of the display data inside the virtual window region 4*a*.

As a result, the storing of the display data outside of the virtual window region 4*a* is carried out later than that of the conventional ones, however, since the display data outside of the virtual window region 4*a* are not displayed on the CRT image plane 7 at this time, no problems to the window image display are recognized.

As stated above, according to the window display control device of the embodiment, when the virtual image plane to be a background of the window image is renewed, since the display data in the virtual window region 4*a* are preferentially renewed and immediately displayed on the image plane, the apparent window image renewal display speed becomes higher than that of conventional ones.

Figure 4:
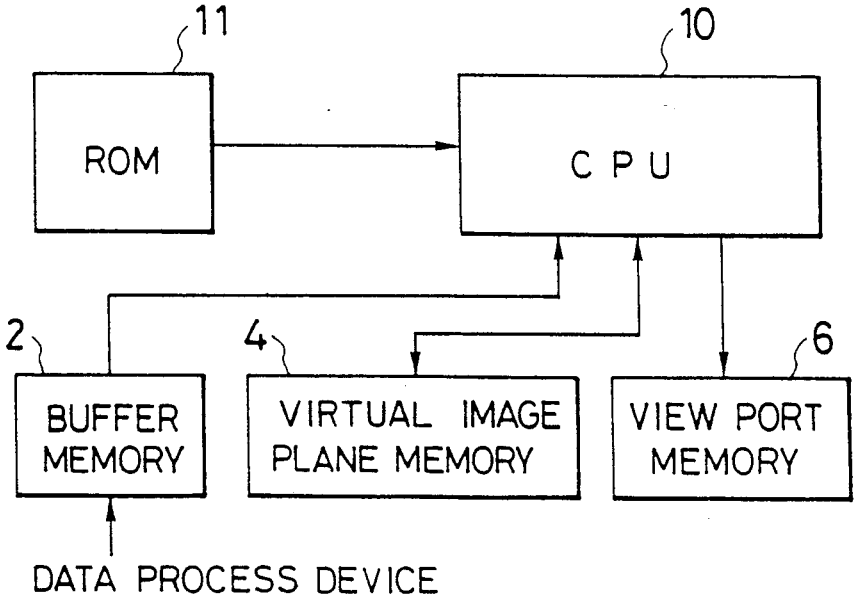
FIG. 4 is a block diagram to show an example of specific construction of the window display control device shown in FIG. 3.

It is possible to provide various concrete constructions of the window display control device as shown in FIG. 3. For example, a construction as shown in FIG. 4 is a general one thereof. The construction mainly comprises CPU 10 for obtaining the functions of the above window display acceleration means data process means and window control means, and ROM 11 for containing programs to carry out processes of the window acceleration means, data process means and window control means in the CPU 10.

As is seen from the above description, according to the present invention, there can be realized high speed window image display on renewal of the virtual image plane in a window display control device of this kind.

Various modifications will become possible for those skilled in the art after receiving the teachings of the present disclosure without departing from the scope thereof.

What is claim is:

1. A window display control device for retrieving and displaying display data in a virtual window region designated in output data from an external device, said window display control device comprising:

(a) a buffer memory to store the output data from the external device;

(b) data process means for converting the output data stored in the buffer memory into display data;

(c) a virtual image plane memory to store display data converted by the data process means;

(d) window control means for separately distinguishing and retrieving only display data localized in a designated virtual window region from the virtual image plane memory in accordance with a display start signal;

(e) a view port memory to store display data, retrieved by the window control means, to be displayed on an image plane; and (f) window display acceleration means for preferentially feeding only a portion of the output data which is located in the virtual window region as output data to the data process means, in accordance with positional information received from the window control means which indicates a position of the virtual window region, for generating and immediately feeding the display start signal to the window control means upon completion of feeding of the portion of the output data, and for thereafter feeding a remaining portion of the output data which is located outside of the virtual window region as output data to the data process means.

* * * * *